United States Patent [19]

Adelmann et al.

[11] Patent Number: 4,457,879

[45] Date of Patent: Jul. 3, 1984

[54] METHOD FOR PRODUCING PRESSED BLANKS FROM CERAMIC POWDER, FOR INSTANCE NUCLEAR REACTOR FUELS

[75] Inventors: Manfred Adelmann, Bruchköbel; Rainer Löb, Obernburg, both of Fed. Rep. of Germany

[73] Assignee: Alkem GmbH, Hanau, Fed. Rep. of Germany

[21] Appl. No.: 334,249

[22] Filed: Dec. 24, 1981

[30] Foreign Application Priority Data

Dec. 29, 1980 [DE] Fed. Rep. of Germany ..... 3049326

[51] Int. Cl.[3] ..... G21C 21/00

[52] U.S. Cl. ..... 264/0.5; 264/56; 264/299; 425/107

[58] Field of Search ..... 264/0.5, 56, 299

[56] References Cited

U.S. PATENT DOCUMENTS 4,060,508 11/1977 Sugahara et al. ..... 252/400.24 X
4,171,337 10/1979 Rosen et al. ..... 264/56
4,284,593 8/1981 Sutcliffe ..... 264/0.5
4,289,191 9/1981 Myllymaki ..... 264/275
4,297,250 10/1981 Gupta et al. ..... 264/61

*Primary Examiner*—Leland A. Sebastian
*Attorney, Agent, or Firm*—Herbert L. Lerner; Laurence A. Greenberg

[57] ABSTRACT

Method for producing molded blanks of ceramic powder, for instance, nuclear reactor fuels such as $UO_2$, $PuO_2$, $ThO_2$ or $(U/Pu)O_2$-mixed oxides in powder form in a mold belonging to the molding device. The device has a die with a hole and a plunger with a head movable in this hole relative to this die, by which the wall of the hole is lubricated with a lubricant, characterized by the feature that a paste and/or wax-like substance, preferably a lubricating grease is used as the lubricant and that it has a dripping point which is higher than the operating temperature of the mold.

11 Claims, 1 Drawing Figure

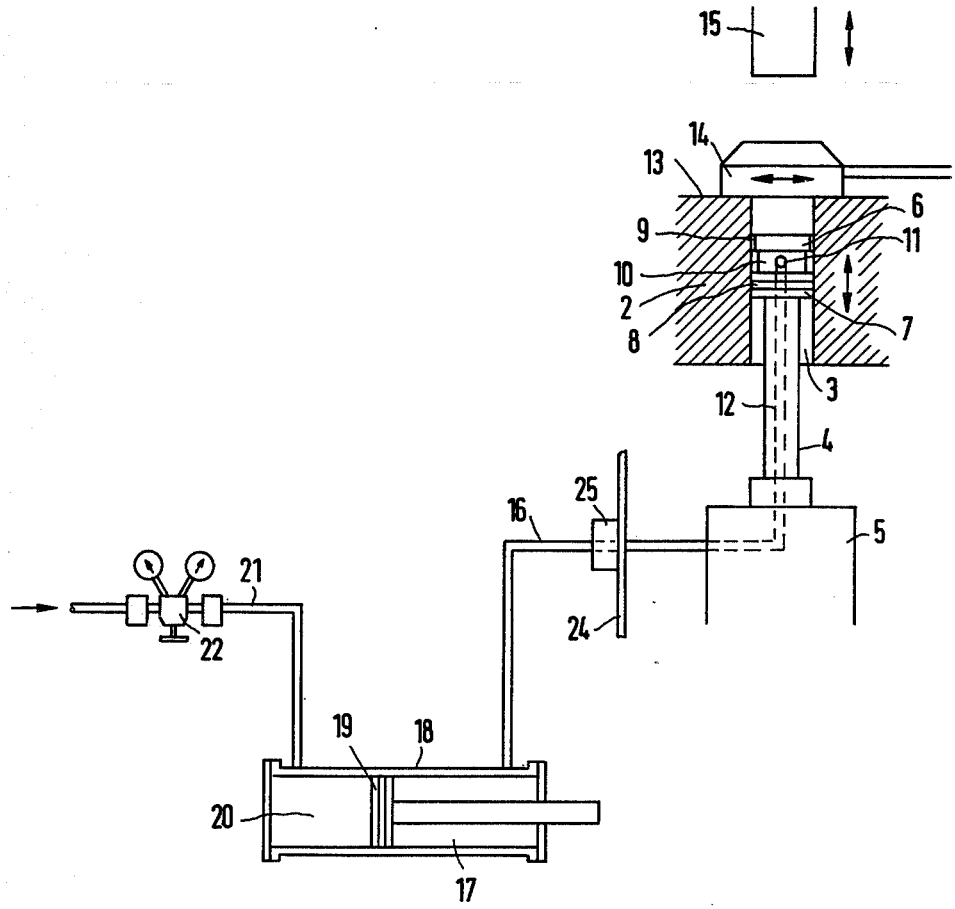
15
14
13
6
9
11
10
2
8
7
3
12
4
25
16
5
21
22
24
19
18
20
17

METHOD FOR PRODUCING PRESSED BLANKS FROM CERAMIC POWDER, FOR INSTANCE NUCLEAR REACTOR FUELS

BACKGROUND OF THE INVENTION

1. Field of the Invention

The invention relates to a method and molding device for producing molded blanks of ceramic powder, for instance nuclear reactor fuels such as $UO_2$, $PuO_2$, $ThO_2$ or $(U/Pu)O_2$-mixed oxides in powder form, in a mold which belongs to the molding press and comprises a die with a hole. In this hole a plunger with a head is displaceable relative to this die. The wall of the hole is lubricated by means of a lubricant by the relative movement of the head of the plunger in the hole.

2. Description of the Prior Art

Such a method and such a molding device are known from German Pat. No. 1 920 308. The device according to this patent is equipped with a lower plunger having a head which has at the outermost end of the plunger, a pressure plate with a pressure surface for the ceramic powder. This head further has a guide part adapted to the cross section of the hole, which is arranged on the side of the pressure plate facing away from the pressure surface at a distance from this pressure plate at the lower plunger. Between the pressure plate and the guide part, the head has an intermediate member which has a smaller cross section than the pressure plate and the guide part and has radial holes which are connected to an axial lubrication canal in the lower plunger.

In such a molding device it is not necessary to add a lubricant, usually organic, to ceramic powder prior to pressing into molded blanks. This lubricant would have to be particularly uniformly distributed in the ceramic powder and, in addition, would have to be removed from these molded blanks before the molded blanks are sintered, by a separate dewaxing anneal.

In the known molding device, the friction between the ceramic powder and the molding tool, particularly the wall of the die hole, is reduced considerably during the pressing of the blanks by a thin film of lubricant on the wall of the die hole. This film of lubricant is formed by an oil as the lubricant which is liquid at the operating temperature of the mold formed of the die and the plunger. This oil is pumped through the axial canal in the lower plunger to the openings of the radial canals in the intermediate member and at the same time, a relative motion between the die and the lower plunger is carried out, for instance by ejecting a molded blank from the hole of the die. The diameters of the pressure plate at the lower plunger are chosen so that they allow the development of a film of lubricant consisting of liquid oil, for instance 10 to 20 $\mu$m thick, on the wall of the die hole.

An important advantage of the known device is that it can generate a uniform lubricant film on the wall of the die hole. Such a uniform film of lubricant on the wall of the die cavity, which is not torn off in any area, is highly important for avoiding different local densities in the molded part, which lead, during the sintering of the molded blank, to deviations from the desired shape or, to a greater extent, to considerable rejects due to chipping off and cracks, and which are caused by different heavy friction occurring in an area at the wall of the die cavity during pressing, where the lubricant film is broken. Unfortunately, conditions of operation occur in which the lubricant film is broken or inadequate causing production of defective blanks and their rejection.

SUMMARY OF THE INVENTION

An object of the invention is to provide a method and a molding device for the formation of a uniform lubricant film without break on the wall of the die cavity in the production of molded blanks in a facile manner to make it more reliable and to lower the number of rejects.

With the foregoing and other objects in view, there is provided in accordance with the invention a method for producing molded blanks of ceramic powder in a mold of a molding device, said device having a die with a hole and a plunger with a head movable in said hole of the die, which comprises introducing a lubricant in said hole, moving said head in the hole of the die to form a continuous, thin film of lubricant on the wall of the hole, introducing ceramic powder into the hole with a film of lubricant on its wall, compressing the powder in the hole to produce a molded blank, and discharging the molded blank from the hole, said lubricant being a paste or wax-like material and having a dripping point determined according to German Standard DIN 51 801, Sheet 1, of May 1972 higher than the operating temperature of the mold formed by the die and the head of the plunger.

In accordance with the invention, there is provided a molding device for producing molded blanks of ceramic powder in a mold which comprises a molding device having a die with a vertical bore hole, an elongated, vertically arranged lower plunger in said hole, said lower plunger extending to and supported by a plunger support disposed vertically underneath the die, a plunger head located inside the hole of the die, a pressure plate at the outermost plunger end having a cross section to leave a narrow gap with the wall of the hole for a lubricant film, a guide body disposed in the hole between the pressure plate and the plunger support, a sealing ring above the guide body, an intermediate part of smaller cross section than the cross section of the hole between the guide body and the pressure plate, open radial holes in the intermediate part connected to an axial lubricant canal in lower plunger, feed means for feeding ceramic powder into the hole, an upper plunger above the hole for compressing the powder into a molded blank, upper plunger moving means for moving the upper plunger into and out of the hole, lower plunger moving means for vertical movement of the lower plunger to eject the molded blank and to lubricate the wall of the hole to be filled with powder, the combination therewith wherein said lubricant canal is connected to a lubricant chamber in a compressed-gas cylinder, said lubricant chamber separated from a compressed-gas chamber by a movable cylinder piston in the compressed-gas cylinder.

Other features which are considered as characteristic for the invention are set forth in the appended claims.

Although the invention is illustrated and described herein as embodied in a method for producing pressed blanks from ceramic powder, for instance nuclear reactor fuels in powder form and pressing device, especially for this method, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing, in which is schematically illustrated a molding device for forming molded blanks of nuclear reactor fuels. The device has a die with a bore hole, a lower plunger in the hole and an upper plunger above the hole. Lubricant from a lubricating chamber is forced by compressed air against a piston through a canal to a plunger head where movement of the plunger head in the hole forms a uniform lubricating film on the wall of the hole.

DETAILED DESCRIPTION OF THE INVENTION

According to the invention, a paste an/or wax-like substance, preferably a lubricating grease, is used as the lubricant.

This has, in particular, the advantage that if the molding device is stopped frequently or for extended periods of time such as occurs in the molding of smaller quantities of molded blanks, the uniformly thick film of lubricant everywhere on the wall of the die cavity is not torn off or open under the influence of gravity because of its resistance to dripping off, as often happens with a film of liquid oil. In addition, no lubricant can escape during an extended shut-down phase of the molding device, through the ring gap between the pressure plate at the head of the plunger and the wall of the die cavity, for instance, to the pressure surface of the pressure plate, as is frequently the case if a liquid oil is used as the lubricant. Such oil that has escaped through the ring gap can lead to oil puddles on the die table which must be carefully removed, or to oil-saturated places in the molded parts. This is prevented with a lubricant or lubricating grease of a paste and/or wax-like substance.

A molding device, particularly for a method according to the invention, with a plunger which is associated with a bore hole of a molding die and in which a lubricant canal leads to radial holes at a plunger head contained in the bore hole, is advantageously characterized by the feature that the lubricant canal is connected to a lubricant chamber in a compressed-air cylinder, which chamber is separated by a movable cylinder piston from a compressed air chamber in the compressed air cylinder. By admitting compressed air to the compressed air chamber, a uniform pressure is steadily exerted on the paste and/or wax-like substance (lubricating grease) contained in the lubricant chamber of the compressed-air cylinder, whereby the substance or the lubricating grease is transported uniformly through the lubricant canal and the radial holes toward the wall of the die cavity.

A molding device with a multiple tool can be equipped by connecting several dies and compressed air cylinders in parallel.

The invention and its advantages will be explained in greater detail with reference to the drawing:

The drawing shows schematically a molding device for manufacturing molded blanks of nuclear reactor fuels in powder form such as $UO_2$, $PuO_2$, $ThO_2$ and/or $(U/Pu)O_2$-mixed oxides. This molding device has a die 2 with a vertical bore hole 3 with which an elongated vertically arranged lower plunger 4 is associated. This lower plunger 4 is arranged on a plunger support 5 disposed vertically underneath the die 2.

The head of the plunger 4 which is located inside the hole 3 of the die 2, has at the outermost plunger end a pressure plate 6, and between the pressure plate 6 and the plunger support 5 a guide body 7 which, likewise, is disposed in the hole 3. The cross section of the guide body 7 fits the cross section of the hole 3. On its cylinder surface it has a sealing ring 8 which is perpendicular to the generatrix lines. The cross section of the pressure plate 6, on the other hand, is chosen so that the latter forms with the wall of the hole 3 a narrow ring gap 9 which allows for the development of a lubricant film, for instance 10 to 20 μm thick, on the wall of the hole 3. Between the guide part 8 and the pressure plate 6 is arranged an intermediate part 10 with distinctly smaller cross section than the cross section of the hole 3, and with open radial holes 11 which are connected to an axial lubricant canal 12 in the lower plunger 4. This axially-directed lubricant canal 12 is indicated by dashed lines and is also conducted through the plunger support 5.

Above the vertically upper opening of the hole 3, a die feed 14 is schematically indicated on the die table 13, and above the die feed 14, an upper plunger 15. The cross section of the upper plunger 15 is fitted to the cross section of the hole 3.

By lever systems, not shown, the die 2 and the upper plunger 15 can be moved in the longitudinal direction of the lower plunger 4, i.e. in the vertical direction, and the die feed 14 can be moved back and forth perpendicularly to the longitudinal direction of the lower plunger 4, i.e. in the horizonal direction.

A pipeline 16, which opens into a lubricating chamber 17 in a compressed-air cylinder 18 is connected to the lubricant canal 12 which extends in the lower plunger 4 and in the plunger support 5. This cylinder 18 is closed off gas-tight at both ends. It has on the inside a piston 19 which can be moved in the lengthwise direction of the cylinder and is provided with a piston rod which extends to the outside of the cylinder and serves to indicate the filling level of the lubricant chamber 17. The piston 19 also separates the lubricant chamber 17 on its one side from the compressed-air chamber 20 on its other side. The compressed-air chamber 20 is connected to a compressed-air tank, not shown, via a pipe 21 into which a compressed-air servicing unit 22 with a compressed-air valve and pressure gages is inserted. Of course, any other suitable compressed gas would be satisfactory, as for example nitrogen, but air has the advantages of being readily available at negligible cost. The lubricant chamber 17 of the compressed-air cylinder 18 is filled with a lubricant or lubricating grease which is a paste and/or wax-like material at the operating temperature of the mold formed by the die tube and the plunger head contained in the die hole 3 (pressure plate 6, guide part 7 and intermediate member 10). By admitting compressed air to the compressed-air chamber 20 of the compressed-air cylinder 18, this paste and/or wax-like material (lubricating grease) is pressed through the pipe 16, the lubricant canal 12 and the radial holes 11 into the ring-shaped space between the pressure plate 6 and the guide part 7.

In starting-up the device, the die feed 14 is first pushed to one side away from the hole 3 and the die 2 is moved once or several times in the longitudinal direction of the lower plunger 4, back and forth in the vertical direction, so that a continuous and uniformly thin film of lubricant is formed everywhere on the wall of the hole 3 to be filled with ceramic powder up to the vertically upper opening of the hole 3. This film consists of a paste and/or wax-like substance or lubricating grease, depending on the content of the lubricant chamber 17 of the compressed-air cylinder 18. The guide body 7, which guides the lower plunger 4 is supported in the plunger support 5, prevents the lubricant film being torn open by the pressure plate 6, which may otherwise result due to a certain amoung of axial and lateral radial play.

Thereupon, the die 2 is locked at a given height relative to the lower plunger 4, so that the pressure plate 6 has a predetermined distance from the vertically upper opening of the hole 3 and, thereby, from the die table 13, forming a predetermined volume in the hole 3 at the vertically upper opening of the hole 3. Then, the die feed 14 is pushed over the upper opening of the hole 3 and the volume formed by the pressure plate 6 and the wall of the hole 3 there is filled with nuclear reactor fuel in powder form up to the die table 13. Then, the die feed 14 is again pushed away horizontally from the upper opening of the hole 3 and the upper plunger 15 is pushed with a predetermined pressure on the nuclear reactor fuel in powder form in the hole 3. Subsequently, the upper plunger 15 is again run vertically upward and the molded blank is ejected from the hole onto the die table 13 by a vertical motion upward of the die 2. In the process, the wall in the hole 3 is at the same time relubricated with the paste and/or wax-like substance (lubricating grease) by developing a lubricant film. The upper plunger 15, the die feed 14, the die 2 and the lower plunger 4 with the plunger support 5 may be contained within a closed glove box, if, for instance, molded blanks are produced which contain plutonium or thorium dioxide. The wall 24 of the glove box is indicated in the drawing only at that point at which the pipeline 16 is brought through it. There, a check valve 25 is also installed in the pipeline 16, so that a return of paste and/or wax-like substance (lubricating grease) which may be contaminated, is prevented from passing from the glove box through the lubricant canal 16.

The consistency or resistance against dripping-off of the paste and/or wax-like substance which is used as the lubricant in the molding device according to the drawing, prevents generally a return of the lubricant if the pressure in the pipeline breaks down. Also prevented are clogging-up by nuclear reactor fuel in powder form, as is frequently the case if liquid oil is used as the lubricant, which takes along powdered nuclear reactor fuel upon flowing back. In addition, no particular adjustment of the pressure in the lubricant chamber 17 of the compressed-air cylinder is necessary while the adjustment of the oil pump requires a very considerable effort if liquid oil is used as the lubricant.

A paste and/or wax-like substance (lubricating grease) is advantageously used as the lubricant, the dripping point of which, determinable according to the German standards DIN 51 801, Sheet 1, of May 1972, is higher than the operating temperature of the mold formed by the die 2 and the head of the lower plunger 4. The operating temperature of the mold is generally about room temperature. The paste and/or wax-like substance which can be used to advantage may be an oil thickened with an organic carrier substance. Of advantage may also be the use of a polymer containing a hydrocarbon in its chain, for instance a polyglycol, as the paste and/or wax-like lubricant. Suitable as paste and/or wax-like lubricants are also aliphatic hydrocarbons, for instance paraffin and/or derivatives of aliphatic hydrocarbons such as ethylene polymers in the form of wax. Suitable as paste and/or wax-like lubricants are also oils thickened with urea.

Advantageously, a paste and/or wax-like substance (lubricated grease) is used as the lubricant, the evaporating temperature of which is below a temperature, preferably of 1000° C., to which the molded blanks are heated in further processing. This ensures that the lubricant residues contained in the molded blanks escape without residue therefrom for instance, when the molded blanks are sintered.

Lubricants which have been proven to be suitable are, for instance, the commercially available lubricating greases sold under the trade name of Aral Multi-Purpose Grease and Klüver Amblygon TA 15/2.

We claim:

1. An intermittent method for producing molded blanks of ceramic powder in a mold of a molding device, said device having a die with a hole and a plunger with a head movable in said hole of the die, which comprises introducing a lubricant in said hole, moving said head in the hole of the die to form a continuous, thin film of lubricant on the wall of the hole, introducing ceramic powder free of a lubricant binder into the hole with a film of lubricant on its wall, compressing the powder in the hole between said head of said plunger and an upper plunger with a cross section fitted to the cross section of the hole to produce a molded blank, and discharging the molded blank from the hole, said lubricant being a paste or wax-like material and having a dripping point determined according to German Standard DIN 51 801, Sheet 1, of May 1972 higher than the operating temperature of the mold formed by the die and the head of the plunger and thereafter repeating said method to produce additional molded blanks.

2. Method according to claim 1, wherein the ceramic powder is an oxide in powder form for nuclear reactor fuels, selected from the group consisting of $UO_2$, $PuO_2$, $ThO_2$ and $(U/Pu)O_2$ mixed oxides.

3. Method according to claim 1, wherein the lubricant of a paste or wax-like material is an oil thickened with an organic carrier substance.

4. Method according to claim 2, wherein the lubricant of a paste or wax-like material is an oil thickened with an organic carrier substance.

5. Method according to claim 3 or claim 4, wherein the organic carrier substance is urea.

6. Method according to claim 1 or claim 2, wherein the lubricant of a paste or wax-like material is a hydrocarbon polymer.

7. Method according to claim 1 or claim 2, wherein the lubricant of a paste or wax-like material is a polyglycol.

8. Method according to claim 1 or claim 2, wherein the lubricant of a paste or wax-like material is an aliphatic hydrocarbon or a derivative of an aliphatic hydrocarbon.

9. Method according to claim 1 or claim 2, wherein the lubricant of a paste or wax-like material is a paraffin.

10. Method according to claim 1 or claim 2, wherein the molded blank is further processed at an elevated temperature, and wherein the lubricant of a paste or wax-like consistency has an evaporation temperature which is below the elevated temperature to which the molded blank is heated in the further processing.

11. Method according to claim 1 or claim 2, wherein the lubricant of a paste or wax-like consistency has an evaporation temperature below 1000° C.

* * * * *